United States Patent [19]

Alter

[11] 4,413,984

[45] Nov. 8, 1983

[54] METHOD AND APPARATUS FOR MAKING WINDOW ENVELOPES

[75] Inventor: Seymour S. Alter, Great Neck, N.Y.

[73] Assignee: New York Envelope Corp., Long Island City, N.Y.

[21] Appl. No.: 259,676

[22] Filed: May 1, 1981

[51] Int. Cl.[3] ..... B31B 1/82

[52] U.S. Cl. ..... 493/222; 493/224; 493/919

[58] Field of Search ..... 493/222, 919, 944, 216, 493/224, 223, 344, 343

[56] References Cited

U.S. PATENT DOCUMENTS

| | | | |
|---|---|---|---|
| 2,703,043 | 3/1955 | Novick et al. | 493/919 X |
| 3,412,655 | 11/1968 | Kranz | 493/919 X |
| 3,435,739 | 4/1969 | Neunkirchen | 493/919 X |
| 3,868,894 | 3/1975 | Watson | 493/222 X |
| 3,957,570 | 5/1976 | Helm | 493/222 X |
| 4,012,268 | 3/1977 | Johnsen | 493/919 X |

*Primary Examiner*—James F. Coan

*Attorney, Agent, or Firm*—Kane, Dalsimer, Kane, Sullivan & Kurucz

[57] ABSTRACT

A method and apparatus for manufacturing window envelopes is provided. After an opening has been cut in an envelope blank and glue applied around the opening, a window patch is secured over the opening and a panel secured behind the window patch. The panel serves as the rear panel of a pocket portion formed behind the window. When the envelope blank is folded and glued into its intended form, it will include both a relatively large compartment and a relatively small pocket. The window patch and pocket panel are cut from webs traveling at unequal speeds and transferred to an envelope blank through the use of cylinders having suction means therein. The patch and panel are carried by a first cylinder which rotates them to a position where they are adjacent a second cylinder. At this point, suction within the first cylinder is terminated so that the suction means within the second cylinder will draw the patch and panel thereto. The second cylinder rotates about its axis and applies the patch and panel to an envelope blank.

14 Claims, 24 Drawing Figures

FIG. 18
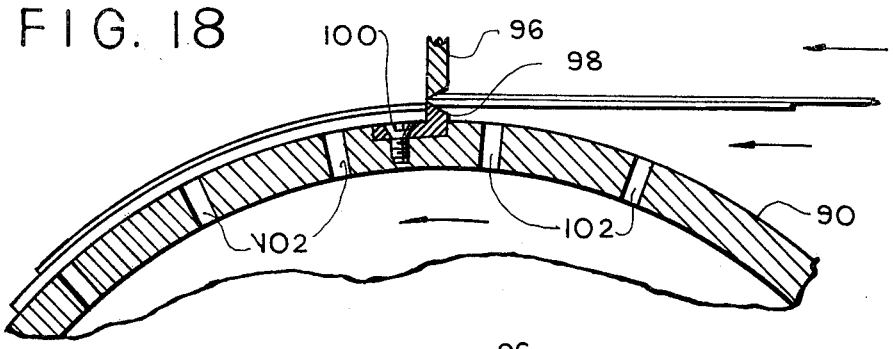
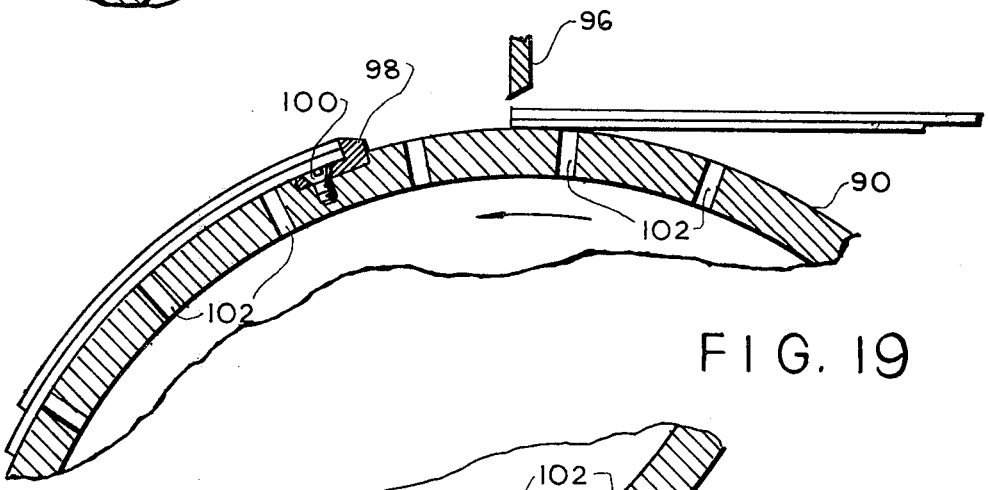
FIG. 19
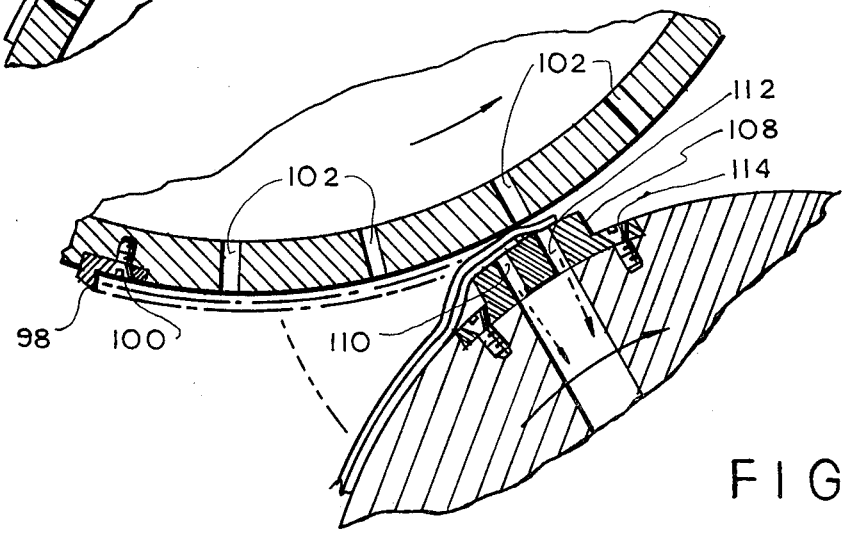
FIG. 20

METHOD AND APPARATUS FOR MAKING WINDOW ENVELOPES

BACKGROUND OF THE INVENTION

The field of the invention concerns an apparatus for manufacturing window envelopes and the methods of operation of said apparatus.

Window envelopes have many applications, particularly in business where a card or other enclosure includes the name and address of the person to whom the envelope is sent. The card is arranged within the envelope such that the necessary information is in registry with the window. By using window envelopes, the time and expense of typing addresses on the envelopes are saved. Proxy statements are often sent in this manner as a pocket portion behind the window for holding the card is provided.

The machinery for manufacturing window envelopes should be as efficient and economical as possible. The envelope must be glued and folded approximately and the window portion secured about an opening therein.

SUMMARY OF THE INVENTION

It is a principal object of the invention to provide a method and apparatus for manufacturing window envelopes. The method and apparatus are designed for reliability, efficiency, and economy.

In accordance with the method of the invention, an integral envelope blank is first provided having a top portion and a bottom portion. The top portion includes a top flap and a pair of opposing lateral flaps. The top and bottom portions are customarily rectangular in shape.

A certain sequence of steps is followed to arrive at the completed envelope, but it will be appreciated that at least some of these steps may be conducted before or after others.

Glue or gum is applied to the top flap of the blank. A window opening is then cut within the top portion. An appropriate pattern of glue is provided about the window opening. The glue extends both around the opening and laterally therefrom. A window patch made from a material such as glassine is placed over the window opening and secured to the envelope by a portion of the pattern of glue. A sheet of material, which will serve as the rear panel of a pocket portion formed behind the window, is secured by means of the glue extending laterally from the window opening. As will be explained below, the window patch and pocket panel are secured simultaneously. The panel has larger lateral dimensions than the path to enable its attachment to the envelope.

After the window patch and pocket panel are secured, a pair of score lines are provided between the top portion of the blank and its lateral flaps. A second pair of parallel score lines are provided between the top portion of the blank and the top flap and between said top portion and the bottom portion.

The lateral flaps are folded towards the side of the blank to which the window patch is attached. Glue is then applied to the exposed surfaces of these flaps. The bottom portion is then folded along the score line extending between it and the top portion and secured to the lateral flaps. A complete envelope is accordingly provided. The envelope may be closed by folding the top flap.

A particularly advantageous method and apparatus is provided for securing the window patch and pocket panel to the envelope blank. Two rolls of sheet-like material are provided, one to serve as window patch material and the other to serve as the panel. The roll of panel material is wider than the roll of window material. The window path material is pulled from its roll at a faster speed than the other material and both are fed to a first roller having suction means therein. Cutting means are provided at or adjacent to said first roller to simultaneously cut the two sheets of material which are positioned one above the other. Because one sheet is moving faster than the other, it will have a longer length.

The suction means within the first roller hold both sheets thereto as it rotates. The rotational speed thereof is preferably faster than the speed at which either sheet is fed thereto.

A second roller is provided which is adjacent to the first roller. As the sheets approach the second roller, the suction means within the first roller is de-actuated while suction means within the second roller are actuated. The sheets are thereby transferred from the first roller to the second.

The bottom of the second roller is positioned adjacent to a path of moving envelope blanks. When the sheets are positioned adjacent the blanks, the suction means within the second roller ceases to operate. The sheets are thereby transferred from the second roller to an envelope blank appropriately positioned beneath it. The blank should already be coated with glue so that the sheets will be attached thereto.

A third roller may be provided beneath the path of blanks and opposite the second roller. It rotates at the same speed as the second roller.

BRIEF DESCRIPTION OF THE DRAWINGS

FIG. 18 is a sectional view of a portion of an apparatus for cutting sheets of material and transferring them to a roller;

FIG. 19 shows a pair of sheets upon the roller of FIG. 18 after a period of time has elapsed;

FIG. 20 shows the transfer of two sheets from the roller of FIG. 19 to a second roller;

DETAILED DESCRIPTION OF THE INVENTION

The invention is directed to a method and apparatus for manufacturing a window envelope having a compartment behind the window.

FIGS. 1–11 show the basic steps which are followed to construct such an envelope.

Figure 1:
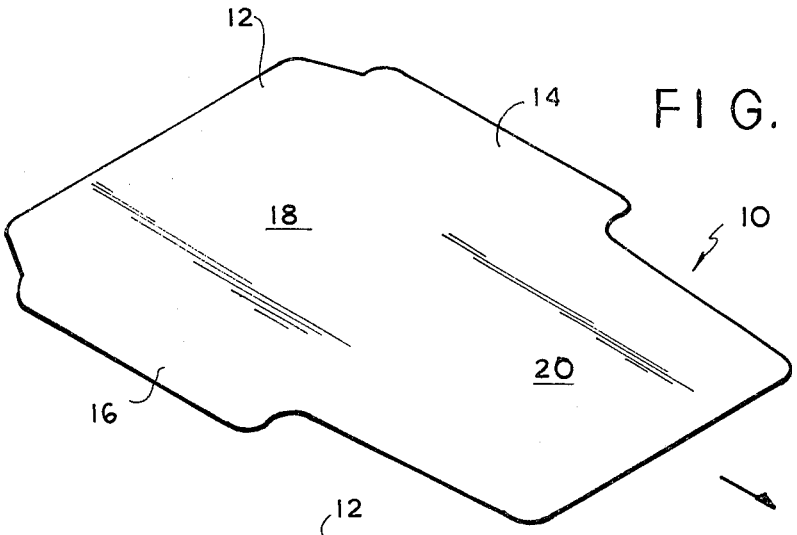
FIG. 1 is a perspective view of an envelope blank.

A paper substrate is cut into an envelope blank 10 as shown in FIG. 1. The blank is generally rectangular in shape with the exception of three flaps 12, 14 and 16 and rounded corners. The blank 10 may be considered to include a top portion 18 and a bottom portion 20. The top portion includes the top flap 12 and a pair of lateral flaps 14 and 16.

Figure 2:
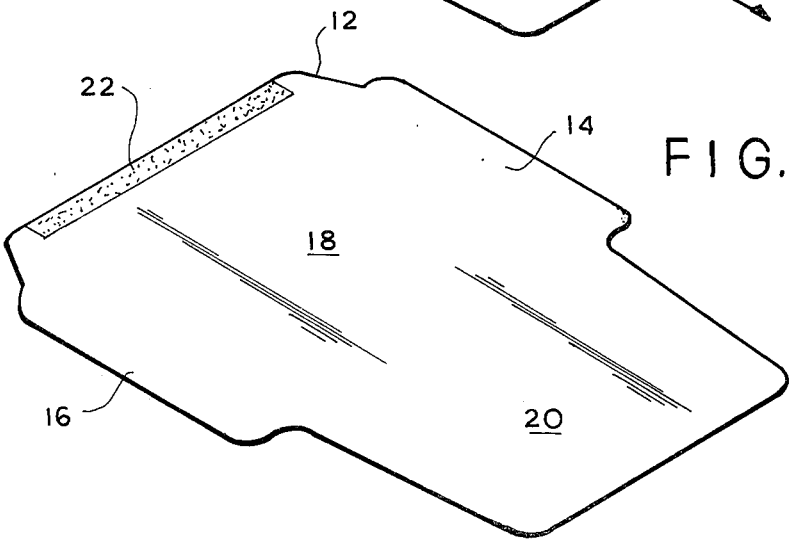
FIG. 2 is similar to FIG. 1 and includes a strip of glue on an upper flap of the blank.
Figure 3:
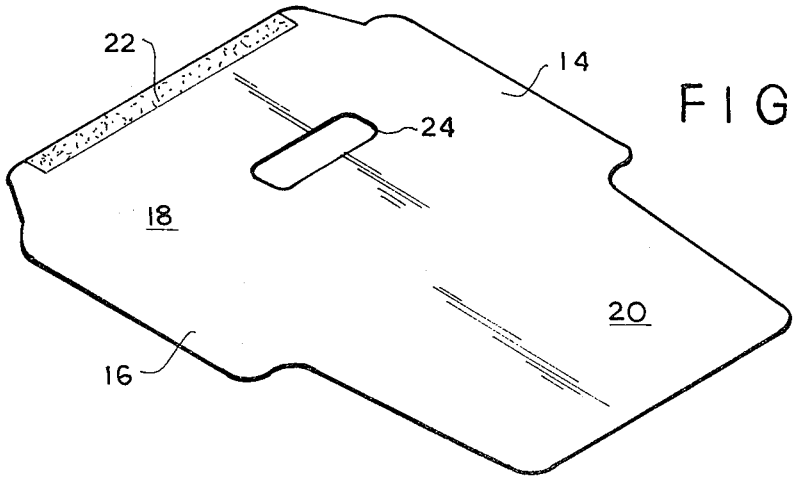
FIG. 3 is similar to FIG. 2 further including an opening cut in said blank.

A strip 22 of gum or glue is applied to a surface of the top flap 12 as shown in FIG. 2. FIG. 3 illustrates a window opening 24 which is cut within the top portion 18 of the blank 10. If the opening is intended to be used to display an address, it will ordinarily have the rectangular shape as shown. It will be appreciated that other dimensions may also be employed and that more than one window can be provided.

A pattern 26 of glue is applied about the window opening 24. In the embodiment shown in FIG. 4, the pattern completely surrounds the opening 24 and extends both laterally and longitudinally therefrom. A relatively small rectangular glue pattern **26*a* is applied about the immediate periphery of the opening. The small rectangle 26*a* is part of a larger rectangle 26*b* which also surrounds the opening. This larger rectangle 26*b* extends both laterally and towards the top flap from the opening 24. A U-shaped glue strip 26*c* surrounds all but the top strip of the large glue rectangle 26*b*. A linear strip 26*d* extending longitudinally within the U-shaped section 26*c*** is also included.

Figure 5:
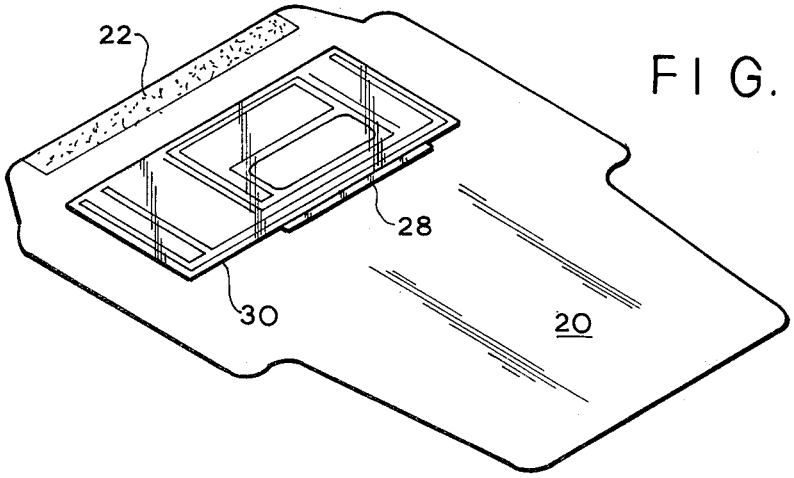
FIG. 5 is similar to FIG. 4 further including a window patch and a panel applied over said opening.

A clear rectangular patch 28 is positioned over the small and large rectangles **26*a*, 26*b* and also covers a corresponding part of the U-shaped strip 26*c*. The patch may be made from glassine or any other substantially transparent material. A rectangular paper panel 30 having larger lateral dimensions than the window patch 28 is positioned over the remaining exposed strips of glue. As shown in FIG. 5, the patch 28 together with the opening 24 allows one to see into the top portion 18 of the blank. The panel 30, the top portion of the blank 10, and portions of glue strips 26*c* and 26*d* define a compartment or pocket behind the window opening 24. The strip 26*d* is positioned so that the pocket can accommodate a card of desired size. Excess lateral movement of the card is undesirable as the information to be seen through the opening 24** would be obscured.

Figure 6:
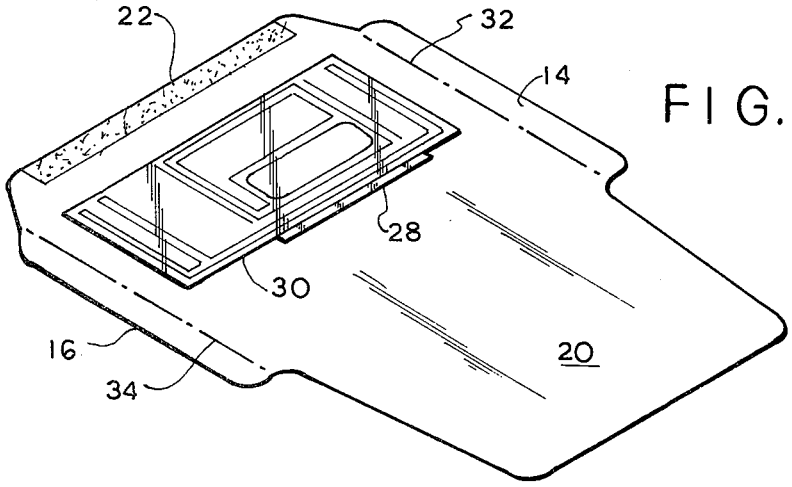
FIG. 6 is similar to FIG. 5 and further includes a pair of score lines applied on said blank.
Figure 7:
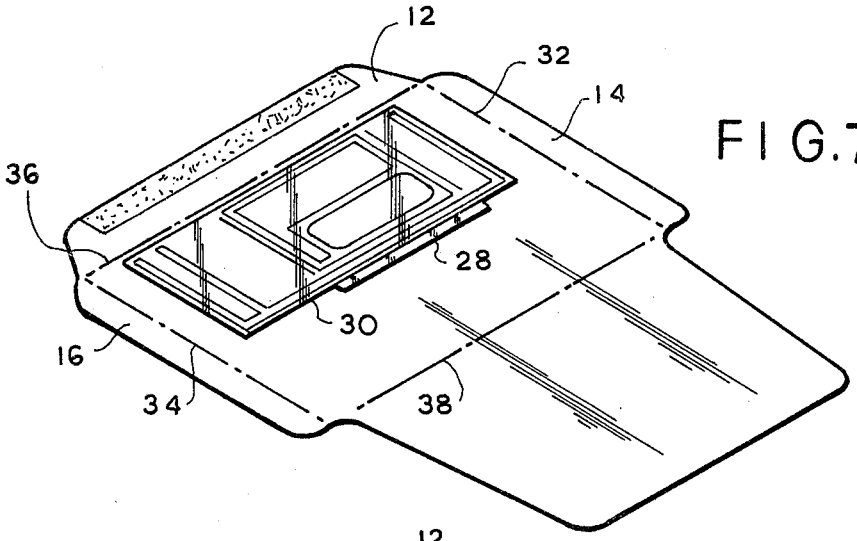
FIG. 7 is similar to FIG. 6 and further includes a second pair of score lines.
Figure 8:
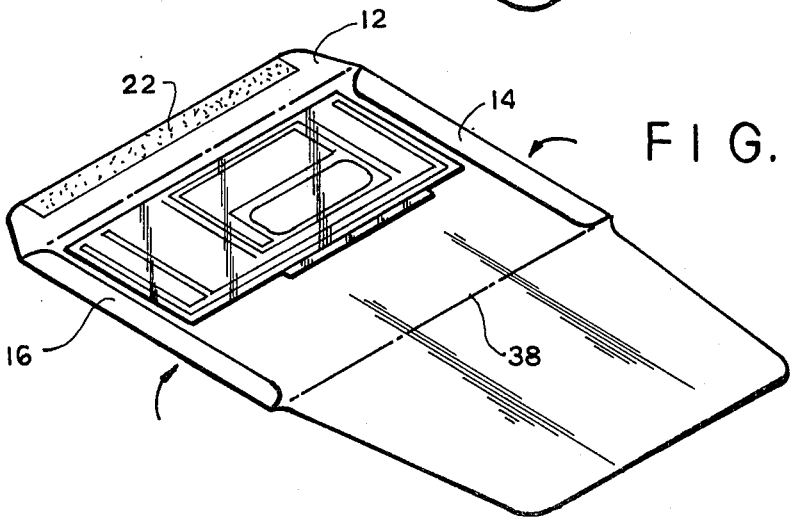
FIG. 8 is similar to FIG. 7 and shows a pair of lateral flaps folded respectively, along a pair of score lines.
Figure 9:
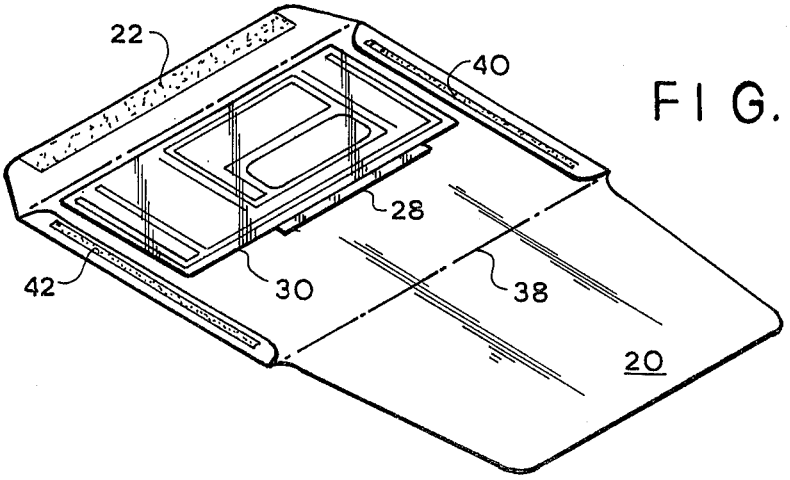
FIG. 9 is similar to FIG. 8 and further includes strips of glue applied to the lateral flaps.
Figure 10:
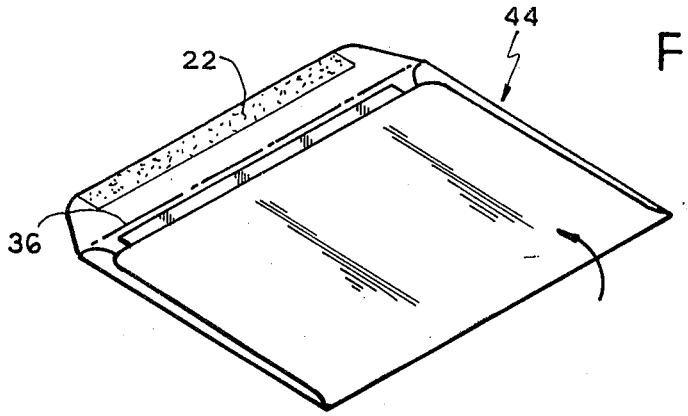
FIG. 10 is similar to FIG. 9 wherein the bottom portion of the blank is folded along a score line and is attached to the lateral flaps.

FIGS. 6 and 7 show the provision of score lines on the blank to facilitate the folding thereof. Scoring rolls, similar to those shown in U.S. Pat. No. 4,008,650, may be utilized upon the blank. Score lines 32 and 34 are provided between the lateral flaps 14, 16 and the top portion 18. A third score line 36 is provided between the top flap 12 and the top portion 18, and a fourth score line 38 between the top and bottom portions 18, 20. Flaps 14 and 16 are folded along score lines 32, 34, respectively, and glue strips 40, 42 are applied thereto. FIGS. 8 and 9 show these steps. The bottom portion 20 of the blank is then folded along line 38 and secured to strips 40, 42 to arrive at the envelope 44 shown in FIG. 10. The envelope 44 includes a pocket defined by the panel 30 and the opposing wall of the blank and a larger compartment defined by portions 18 and 20.

Figure 11:
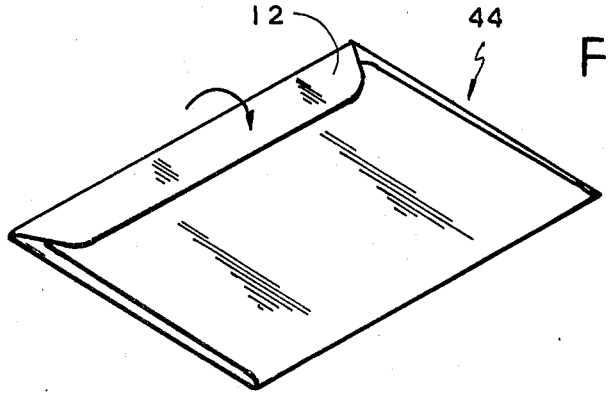
FIG. 11 is similar to FIG. 10 and shows the upper flap folded along a score line.
Figure 12:
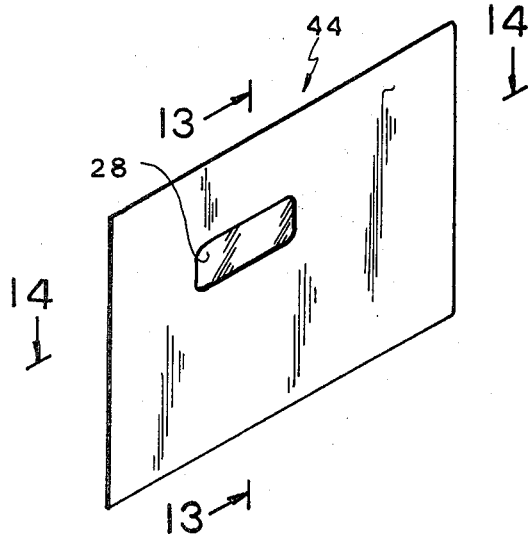
FIG. 12 is a front perspective view of the envelope shown in FIG. 11.

The envelope may be sealed by folding the top flap 12 as shown in FIG. 11. FIG. 12 is a perspective view of the front of the envelope 44.

Figure 14:
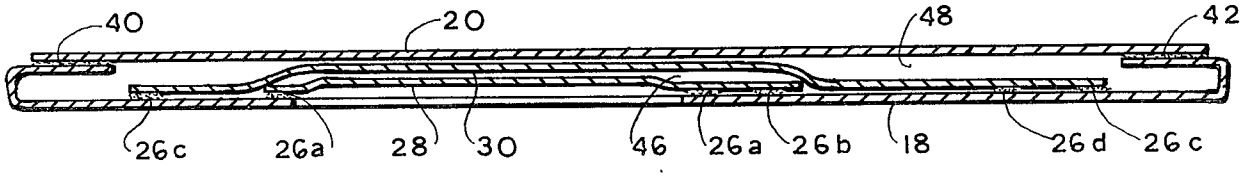
FIG. 14 is a sectional view of the envelope shown in FIG. 12 taken along the plane of line 14—14 in FIG. 12.
Figure 13:
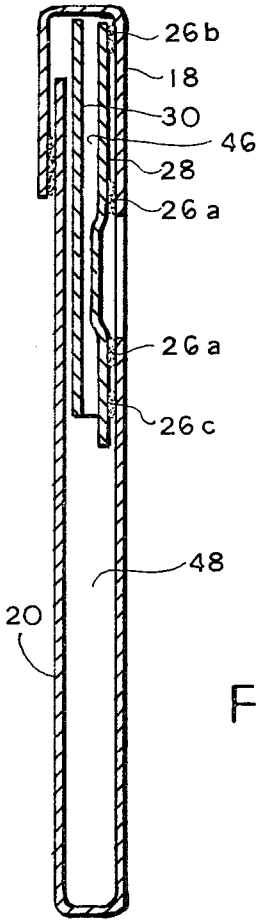
FIG. 13 is a sectional view of the envelope shown in FIG. 12 taken along the plane of line 13—13.

FIGS. 13 and 14 are sectional views of the envelope 44, and clearly show both the small pocket 46 and the larger compartment 48. The dimensions are exaggerated for purposes of clarity.

Figure 4:
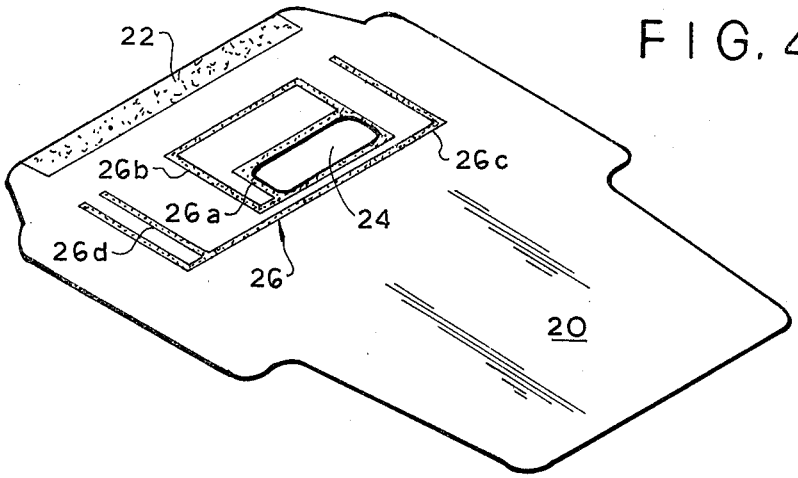
FIG. 4 is similar to FIG. 3 and further includes a pattern of glue applied around said opening.
Figure 15:
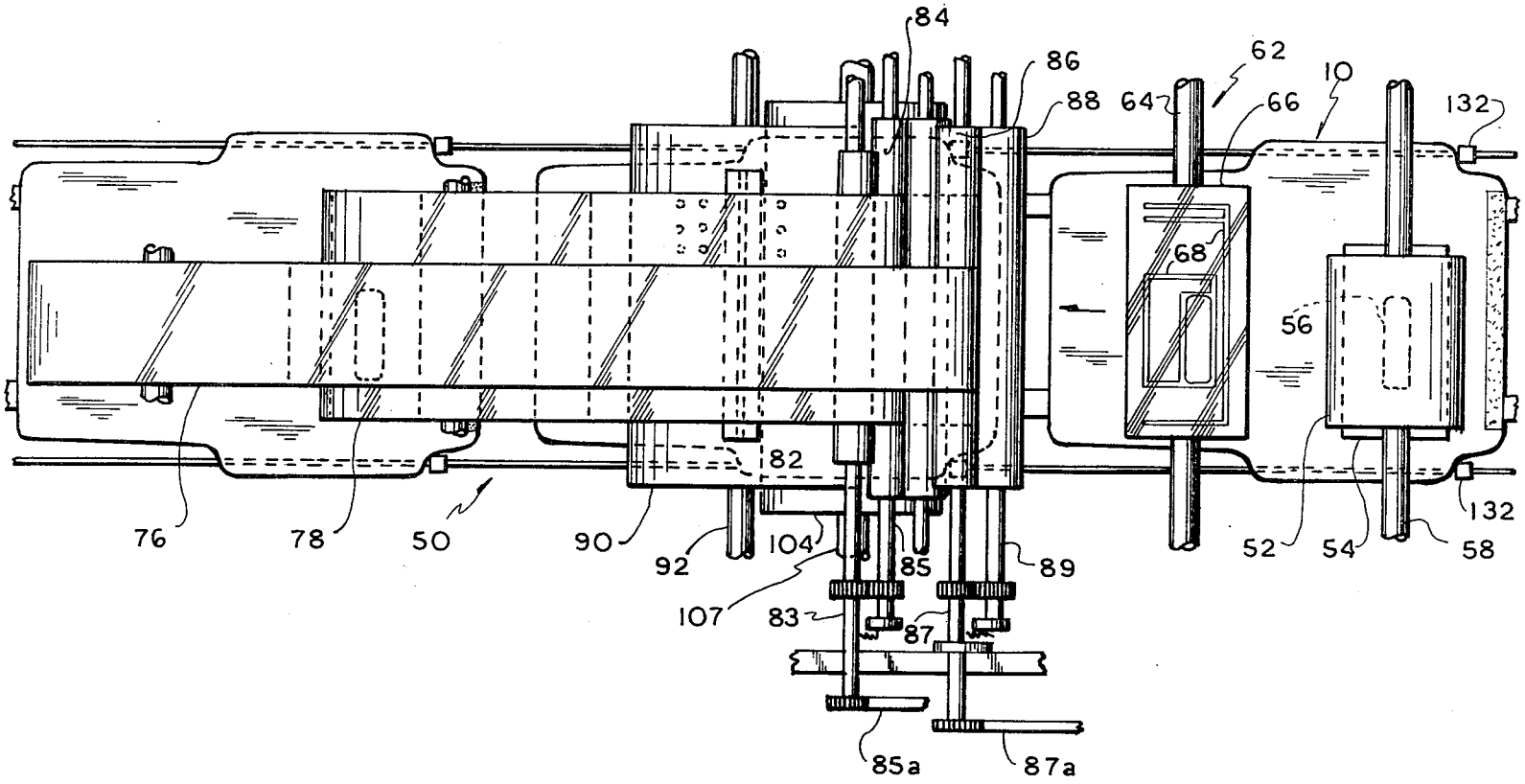
FIG. 15 is a plan view of a portion of an apparatus for manufacturing a window envelope.
Figure 16:
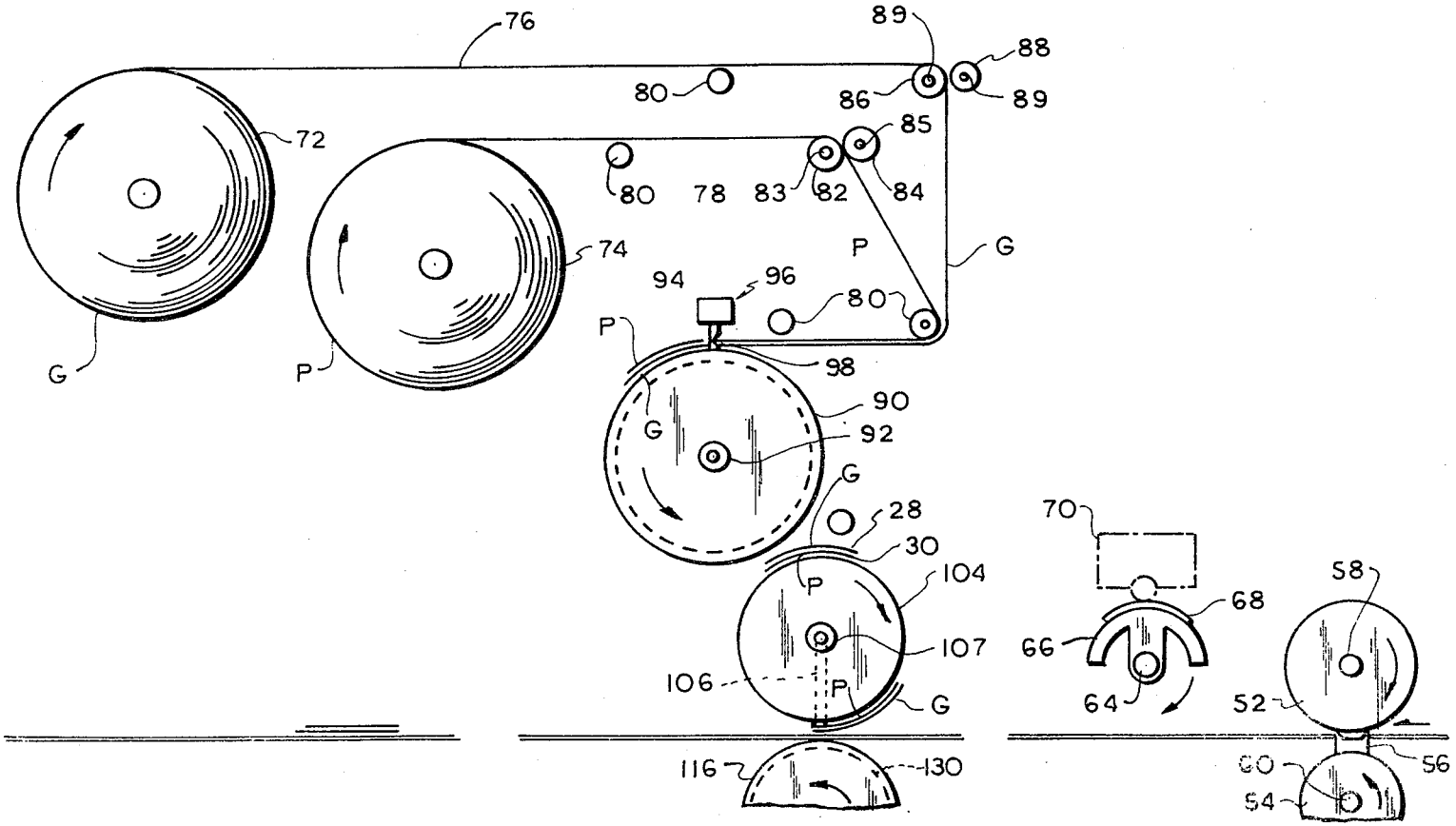
FIG. 16 is a schemtaic view of a portion of an apparatus for manufacturing a window envelope.

FIG. 15 illustrates an apparatus 50 for performing the steps shown in FIGS. 3, 4 and 5. FIGS. 16–20 provide schematic view of the apparatus and method shown in the above described figures.

A plurality of envelope blanks 10 are positioned on the apparatus 50. The blanks pass from right to left in FIG. 15 as shown by the arrow. A pair of rollers 52, 54 at the right hand side of the figure are provided for cutting the window openings within the blanks. One of the rollers 54 has a cutting device 56 thereon having edges corresponding to the shape of the desired opening. Each of the rollers 52, 54 is mounted upon shafts 58, 60 passing through their respective axes.

A glue applicator 62 is provided to apply the glue pattern 26 about opening 24. The applicator includes a shaft 64, a semicylindrical structure 66 mounted upon the shaft 64, and a pattern 68 of lines protruding from the structure 66. The pattern 68 corresponds to that which is provided about the opening 24. Means 70 are provided for applying glue to the pattern 68 as it rotates about the axis of shaft 64.

A pair of rolls 72, 74 of glassine 76 and paper 78, respectively, are provided for forming the window and pocket portions of the envelopes. Each web proceeds from the respective rolls and is guided by a plurality of guide rolls 80. The paths traveled by the webs are most clearly shown in FIGS. 16–20.

Means are provided for moving the glassine web at a faster rate than the wider paper web. The means include rollers and shafts 82–89 which will be described in greater detail below.

The two webs proceed about the guide rolls and are arranged so that the paper overlaps the glassine. A first cylinder 90 is provided to receive the overlapped webs. Means are provided for rotating the cylinder 90 about a shaft 92 at a speed greater than the speed at which either web travels.

Cutting means 94 are provided above and adjacent to the cylinder 90 for simultaneously cutting the webs at regular intervals. The cutting means includes a stationary blade 96 and a blade 98 affixed to and rotating with the cylinder 90. The rotating blade 98 is secured to the cylinder by means of a screw 100 as shown in FIGS. 18–20. Cutting action occurs when the blades are aligned.

The outer wall of the cylinder 90 is provided with a plurality of rows of perforations 102 therein. Suction is maintained within the cylinder such that the glassine window patch 28 and pocket panel 30 adhere thereto. Since the paper web is wider than the glassine material, the lateral portions thereof will overlie portions of the perforations.

A second cylinder 104 is provided adjacent to the first cylinder 90. In the embodiment shown in the Figures, it is positioned beneath the first cylinder and slightly to one side in the direction of rotation thereof. The second cylinder 104 includes a suction passage 106 therein and rotates about shaft 107. A plate 108 including a pair of rows of perforations 110, 112 is secured to the outer wall of the second cylinder by means of a pair of screws 114. As shown in FIG. 20, the distance between the rows 110, 112 correspond to the extent which the glassine extends beyond the paper. Means are provided for rotating the second cylinder about its longitudinal axis.

A third cylinder 116 may be positioned under the second cylinder 104. It is rotatable about its longitudinal axis and includes a plurality of suction holes therein.

Figure 21:
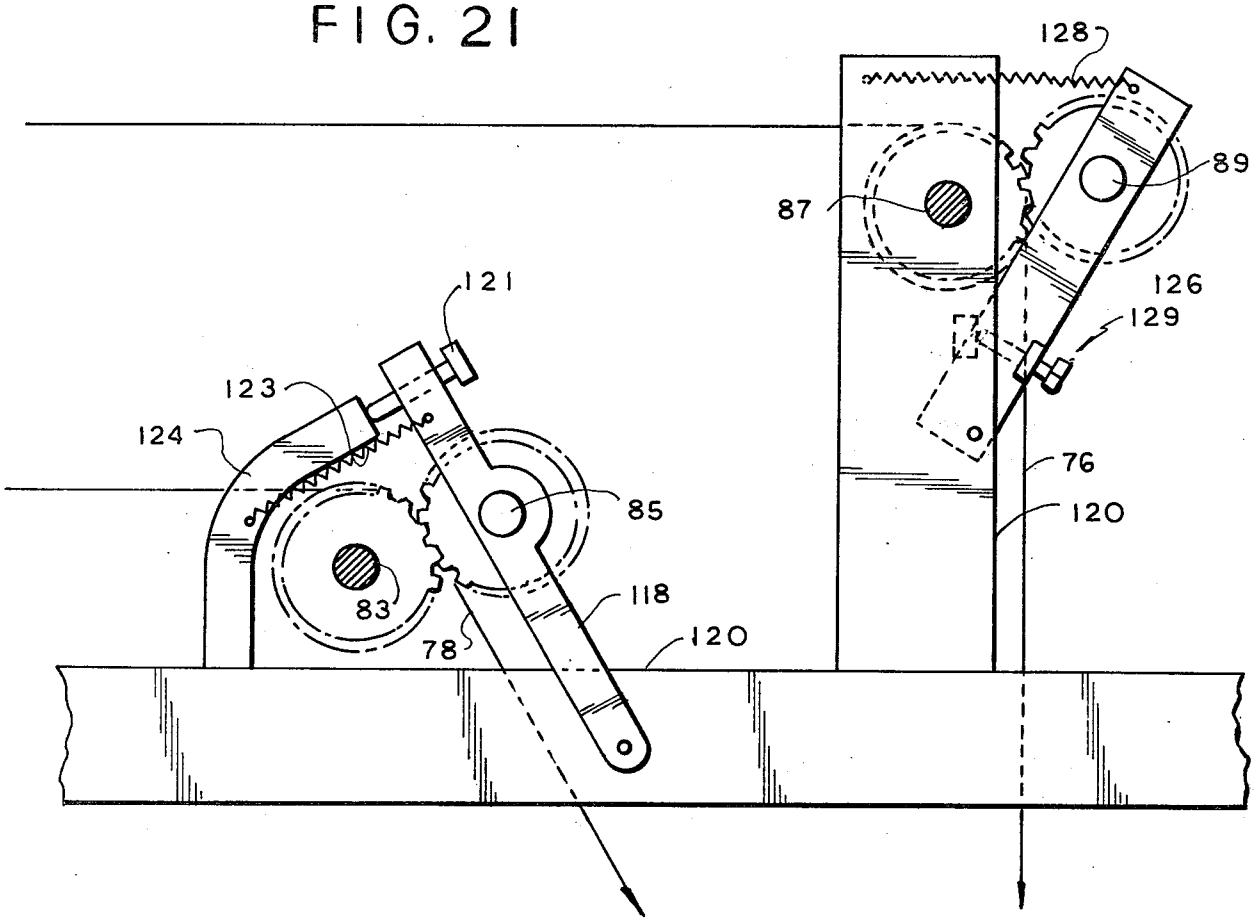
FIG. 21 is an enlarged and more detailed view of a portion of the assembly shown in FIG. 16.

FIG. 21 provides a more detailed view of the rollers 82–88. In the embodiment shown in the Figures, the roller 82 is mounted to a shaft 83 having a portion including 31 gear teeth. Roller 86 is mounted to a shaft 87 having 27 teeth. Chain and sprocket assemblies 83A and 87A are actuated by a main drive to rotate shaft 87 at a faster rate than shaft 83. The glassine web which is driven by roller 86 accordingly moves faster.

Roller 84 is mounted to a pair of rods 118 which are pivotally secured to the frame 120 of the apparatus 50. An adjusting screw 121 enables one to engage or disengage the gear teeth of the two shafts 83, 85. The roller 84 and rods 118 are biased towards roller 82 by means of springs 122. The springs 122 extend between eyeholes in rods 118 and in frame extensions 124.

Roller 88 is mounted between a pair of rods 126. The rods 126 are pivotally secured to the frame 120. Springs 128 extending between eyeholes in the frame 120 and rods 126 urge the two rollers 86, 88 together. Adjusting means 129 are provided to serve a similar function as the adjustment screw 121.

In operation, the rolls of paper 78 and glassine 76 are rotated by means of the shafts and rollers 82–89. The paper web proceeds at a slower rate than the glassine and overlaps it at least in the vicinity of the first cylinder 90. The two webs pass over the walls of the cylinder 90 as it rotates. The speed of rotation of the cylinder and speed of the webs is arranged such that a desired portion of the webs passes over the cylinder 90 by the time it is cut by the action of blades 96, 98. The cuttin operation is shown in FIG. 18. Because the glassine web travels at a faster speed than that of the paper web, a greater length of it will pass over the cylinder 90 before the blades perform their function. The circumferential speed of the cylinder is greater than the speed of either web.

Figure 17A:
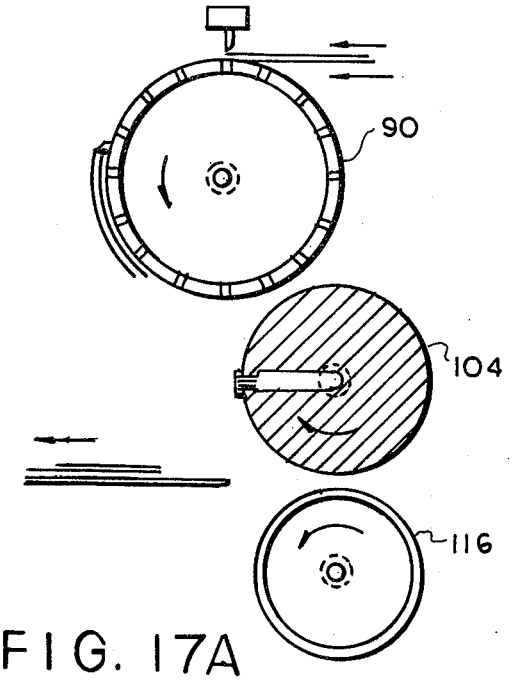
FIGS. 17A—17D are schematic views of an apparatus and method for providing two sheets of material on an envelope blank.

Suction should be applied to the perforations 102 before the webs are cut by the blades to prevent them from either falling from or being displaced upon the cylinder 90. Once the webs are cut, the pieces upon the cylinder will be referred to as the window patch 28 and the pocket panel 30. The patch and panel rotate with the cylinder as shown in FIG. 17A.

Figure 17C:
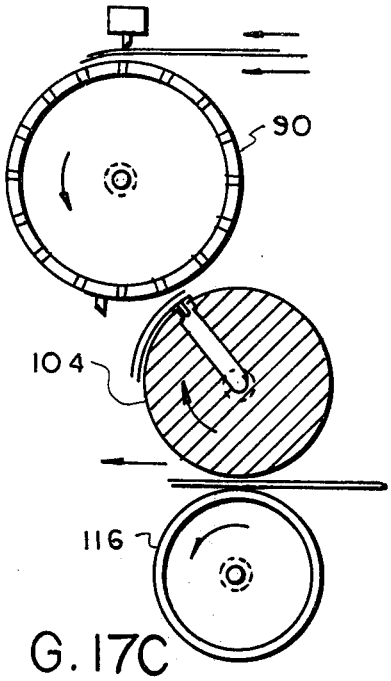
Figure 17B:
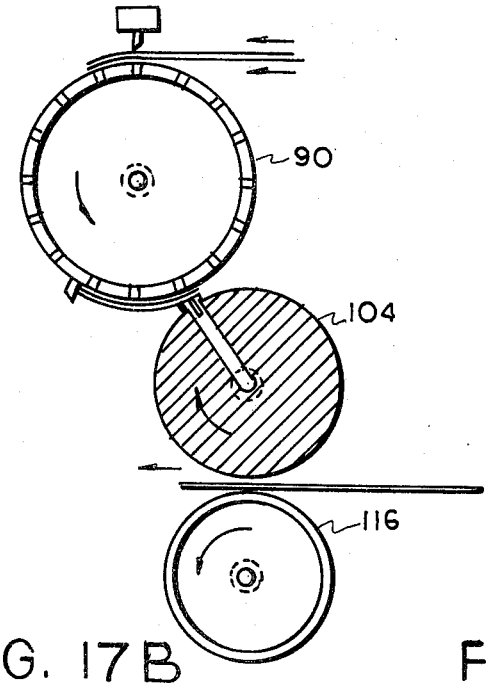

When the cylinder 90 reaches the portion shown in FIG. 17B, the second cylinder 104 is properly synchronized such that its rows of perforations 110, 112 are directly opposite the ends of the paper and glassine, respectively. The suction exerted by these perforations tends to draw the patch and panel to the second cylinder. The suction within the first cylinder 90 is then removed so that the entire patch and panel are transferred to the second cylinder as shown in FIGS. 17B, 17C and 20.

Figure 17D:
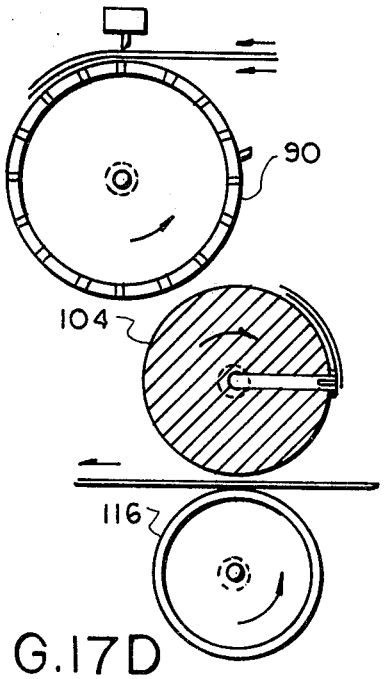

The transferred glassine and paper are carried by the second cylinder as it continues to rotate in the direction opposite to the first cylinder (FIG. 17D). When it reaches the point shown in FIG. 16, the suction within the second cylinder is removed. The window patch and pocket panel are thereby released onto an envelope blank 10 passing below to arrive at the structure shown in FIG. 5.

Although the envelope blanks should pass under the second cylinder in proper sequence, if one should be missing, the third cylinder 116 is adapted to remove the glassine and paper. It rotates at the same speed as the second cylinder and has suction holes 130 therein. Conveyor means 132 of the pusher and chain variety may be provided for carrying the envelope blanks along the desired path.

It is apparent from the drawings that the process described above is a continuous one capable of the mass production of window envelopes. All steps are properly sychronized for optimal performance.

Those skilled in the art will appreciate that modifications can be made in the method and apparatus described above without materially departing from the spirit of the invention. The scope of the invention should accordingly be determined by reference to the appended claims.

What is claimed is:

1. A method for manufacturing a window envelope comprising the steps of:

providing an envelope blank having an opening cut therein;

providing a first rotatable cylinder having suction means capable of holding a sheet of material at its surface;

providing a second rotatable cylinder having suction means capable of holding a sheet of material at its surface, said second cylinder having a surface portion in proximity to said first cylinder;

feeding at least two overlapped sheets to said first cylinder, at least one of said sheets being able to transmit light;

rotating said first cylinder while said suction means holds said overlapped sheets to the surface thereof;

de-actuating said suction means of said first cylinder when said sheets are rotated to a point where they are in proximity to said second cylinder, said suction means of said second cylinder causing said sheets to be transferred thereto;

rotating said second cylinder so that said sheets are positioned in proximity to the envelope blank; and transferring said sheets to said envelope blank from said second cylinder such that the light transmitting sheet directly overlies said opening and said other sheet is positioned behind said light transmitting sheet.

2. A method as described in claim 1 wherein the suction means of the second cylinder is deactuated when the sheets are in proximity to said envelope.

3. A method a described in claim 1 including the steps of feeding a pair of overlapping webs to said first cylinder, at least one of said webs being made from a material capable of transmitting light; cutting said webs into overlapping sheets as they approach the first cylinder; and rotating said first cylinder at a circumferential speed faster than the linear speed at which either web is fed thereto.

4. A method as described in claim 3 wherein a stationary cutting blade is positioned near said first cylinder, a second cutting blade is mounted to said first cylinder and rotatable therewith, including the steps of passing said webs between the stationary cutting blade and first cylinder and cutting said webs by means of said cutting blades when said second cutting blade is rotated to a position where it is aligned with said stationary cutting blade.

5. A method as described in claim 4 including the step of feeding said web of light transmitting material to said first cylinder at a faster rate than said other web such that the sheet cut therefrom has a greater length than said other sheet.

6. A method as described in claim 4 wherein said web of light transmitting material has a narrower width than the width of said other web.

7. A method as described in claim 5 wherein said second cylinder includes at least two rows of perforations which draw said sheets thereto, the speeds of the cylinders arranged such that a first of said rows holds an end of said light transmitting sheet while a second of said rows holds an adjacent end of said other sheet.

8. A method as described in claim 4 wherein said second cylinder is rotated in the opposite direction of said first cylinder.

9. A method as described in claim 4 including the step of feeding said webs to said first cylinder continuously, rotating said cylinders continuously, and successively passing envelope blanks in proximity to said second cylinder.

10. An apparatus for manufacturing window envelopes, comprising:

a first rotatable cylinder having suction means capable of holding a sheet of material at its surface;

a second rotatable cylinder having suction means capable of holding a sheet of material at its surface, said second cylinder having a first surface portion in proximity to said first cylinder;

a first cutting blade positioned adjacent to said first cylinder, a second cutting blade extending from the surface of the front cylinder and rotatable therewith, said cutting blades arranged to cut a sheet of material when they are aligned;

means for feeding a pair of overlapping webs to said first cylinder, said webs passing between said first cutting blade and said first cylinder, means for feeding one of said webs at a faster speed than the other of said webs; and means for passing envelope blanks in proximity to a second surface portion of said second cylinder.

11. An apparatus as described in claim 1 further including means for cutting a window opening in envelope blanks and means for applying an adhesive material about openings cut in envelope blanks.

12. An apparatus as described in claim 1 wherein said first cylinder includes a plurality of rows of perforations.

13. An apparatus as described in claim 12 wherein said second cylinder includes a suction passage therein which terminates in a pair of rows of perforations.

14. An apparatus as described in claim 1 further including a third rotatable cylinder positioned adjacent to said second surface portion of said second rotatable cylinder, said third cylinder including suction means capable of holding a sheet of material at its surface.

* * * * *

UNITED STATES PATENT AND TRADEMARK OFFICE

CERTIFICATE OF CORRECTION

PATENT NO. : 4,413,984

DATED : November 8, 1983

INVENTOR(S) : Seymour S. Alter

It is certified that error appears in the above-identified patent and that said Letters Patent is hereby corrected as shown below:

Column 1, line 53, "path" should be --patch--;

Column 2, line 7, "path" should be --patch;

Column 5, line 51, "cuttin" should be --cutting--;

Column 6, line 65, "a" should be --as--;

Column 8, lines 22, 25 and 31, "claim 1" should be --claim 10--.

Signed and Sealed this

Tenth Day of January 1984

[SEAL]

*Attest:*

GERALD J. MOSSINGHOFF

*Attesting Officer*

*Commissioner of Patents and Trademarks*